US005791436A

United States Patent [19]

Talley, Sr.

[11] Patent Number: 5,791,436

[45] Date of Patent: Aug. 11, 1998

[54] TREE STAND

[76] Inventor: James Ray Talley, Sr., 3501H. Wetumpka Hwy., Montgomery, Ala. 36110

[21] Appl. No.: 681,402

[22] Filed: Jul. 23, 1996

[51] Int. Cl.[6] ..... E06C 7/16

[52] U.S. Cl. ..... 182/116; 182/187

[58] Field of Search ..... 182/20, 116, 178, 182/187, 120, 123

[56] References Cited

U.S. PATENT DOCUMENTS

| | | | |
|---|---|---|---|
| 1,600,572 | 9/1926 | Bauer | 182/116 X |
| 4,134,474 | 1/1979 | Stavenau et al. | 182/187 |
| 4,246,981 | 1/1981 | Stavenau | 182/116 |
| 4,552,246 | 11/1985 | Thomas | 182/116 |
| 4,552,247 | 11/1985 | Purdy | 182/116 |
| 4,579,198 | 4/1986 | Lee | 182/115 |
| 4,742,888 | 5/1988 | Amacker | 182/116 |
| 4,905,792 | 3/1990 | Wilson | 182/187 |
| 4,942,942 | 7/1990 | Bradley | 182/136 X |
| 5,105,908 | 4/1992 | Freund | 182/20 |
| 5,241,772 | 9/1993 | Hall | 43/1 |
| 5,242,030 | 9/1993 | Lobozzo | 182/116 X |
| 5,253,732 | 10/1993 | Daniels | 182/20 X |
| 5,279,390 | 1/1994 | Phillips | 182/187 |
| 5,332,063 | 7/1994 | Amacker | 182/116 |
| 5,363,941 | 11/1994 | Richard | 182/187 |
| 5,368,127 | 11/1994 | Phillips | 182/187 |
| 5,371,966 | 12/1994 | Hall | 43/1 |
| 5,492,198 | 2/1996 | Williams | 182/136 |
| 5,590,738 | 1/1997 | Hunt et al. | 182/187 X |

*Primary Examiner*—Daniel P. Stodola
*Assistant Examiner*—Richard M. Smith
*Attorney, Agent, or Firm*—Jacobson, Price, Holman & Stern, PLLC

[57] ABSTRACT

A collapsible tree stand to provide an elevated support for a hunter or hunters against a tree trunk. The stand includes an elongated sectional ladder having a platform seat and footrest each pivotally attached to the uppermost ladder section. The platform seat also includes safety front and side rails removably associated with the seat. An anchoring structure is provided for securing the tree stand to the tree. The seat and footrest are dimensioned to accommodate a single occupant or two occupants. When disassembled, the safety rails attach and nest, and the platform seat and footrest collapse and nest with respect to the uppermost ladder section, for compact transport and storage.

19 Claims, 4 Drawing Sheets

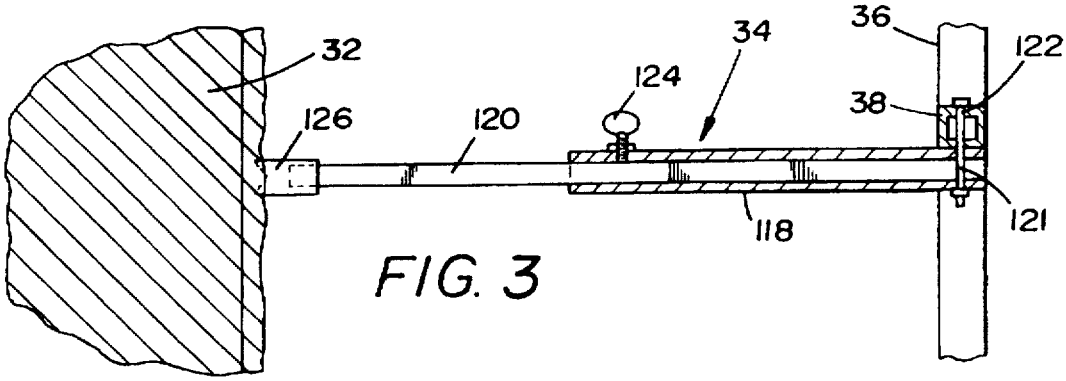
FIG. 3
FIG. 9
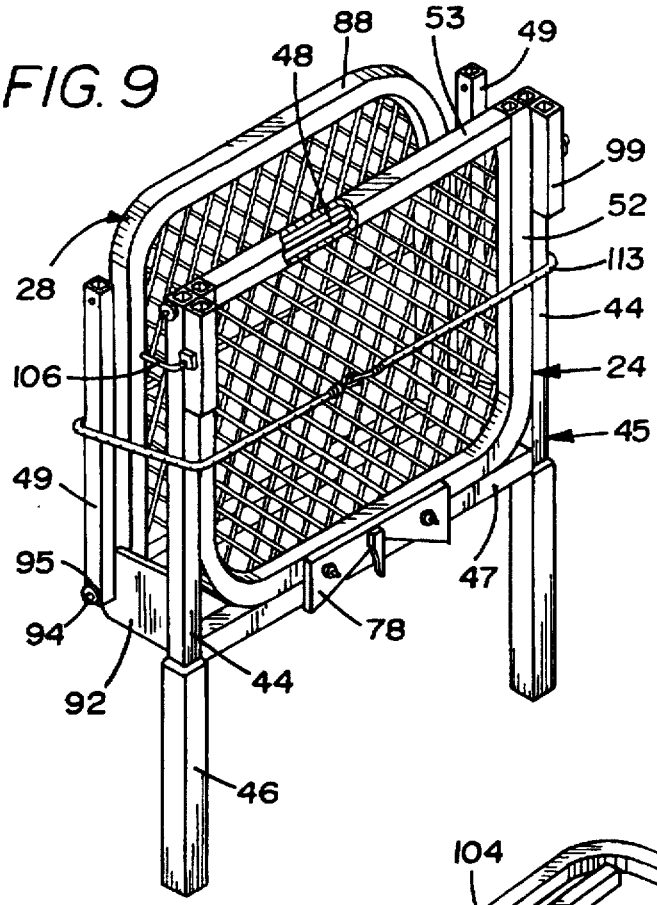
FIG. 7
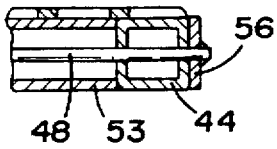
FIG. 8
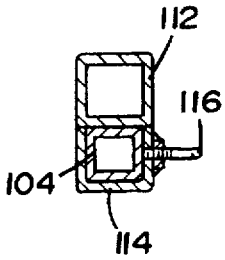
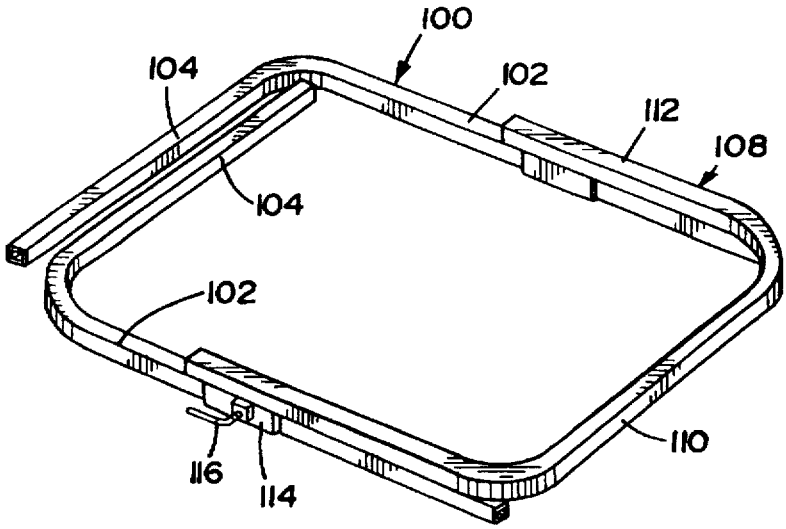
FIG. 10

FIG. 4
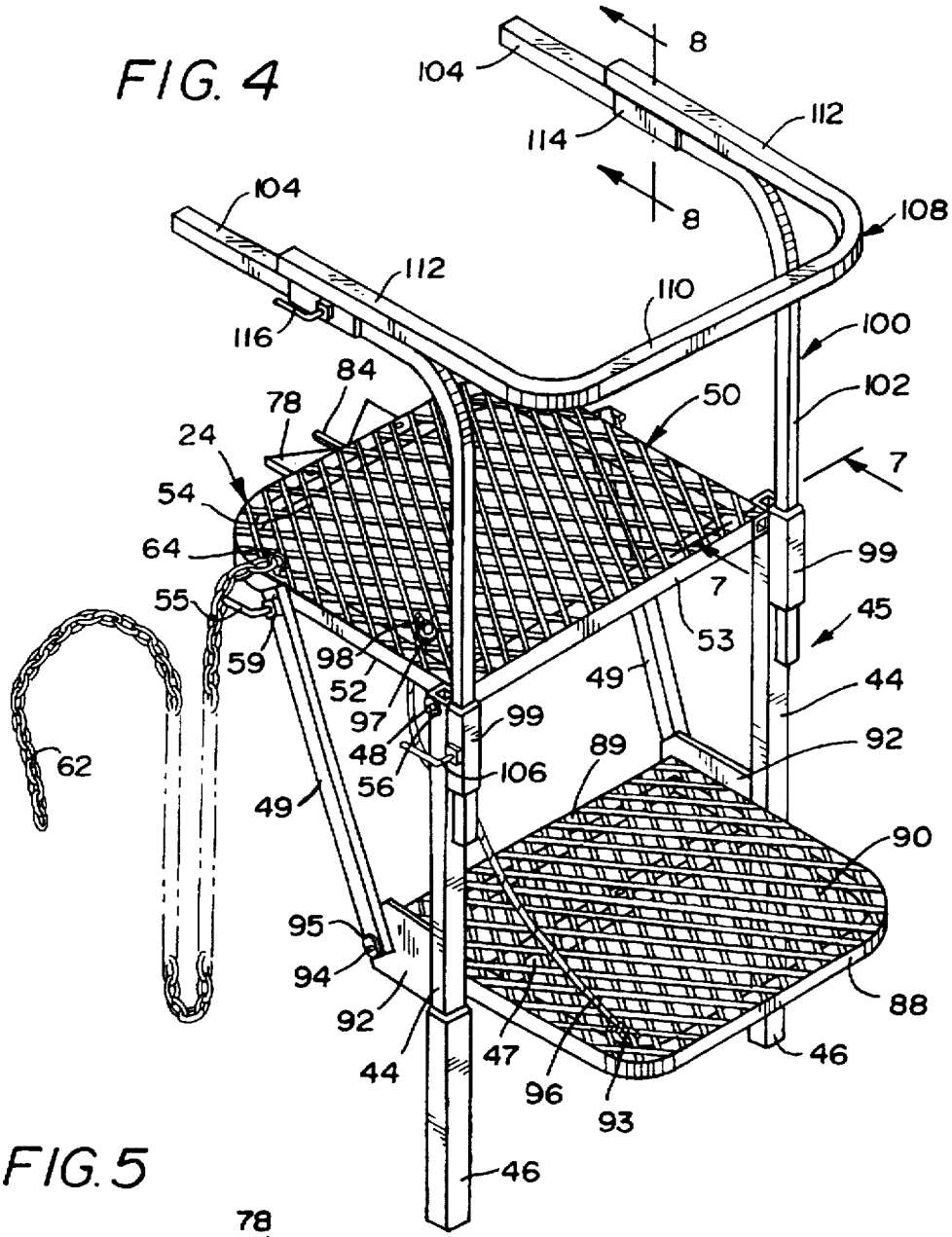
FIG. 5
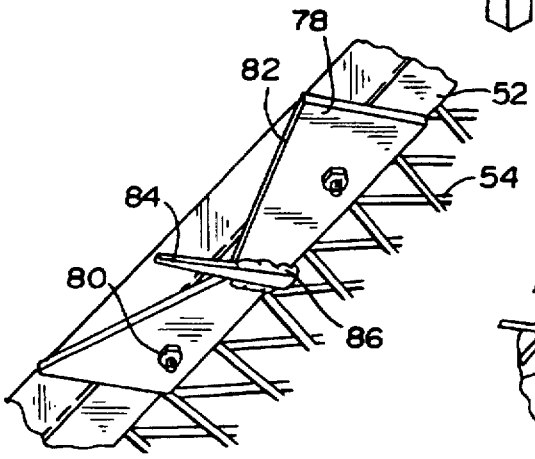
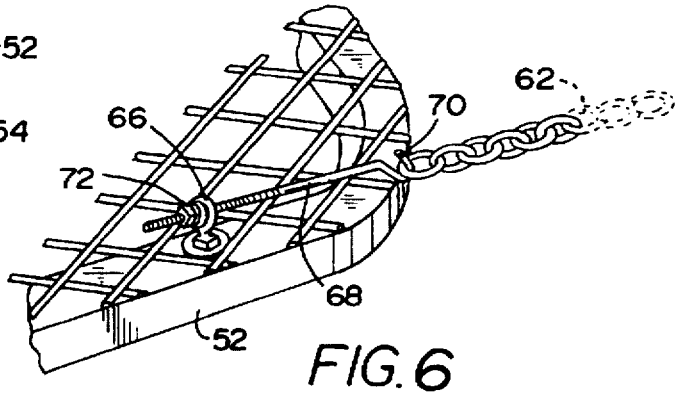
FIG. 6

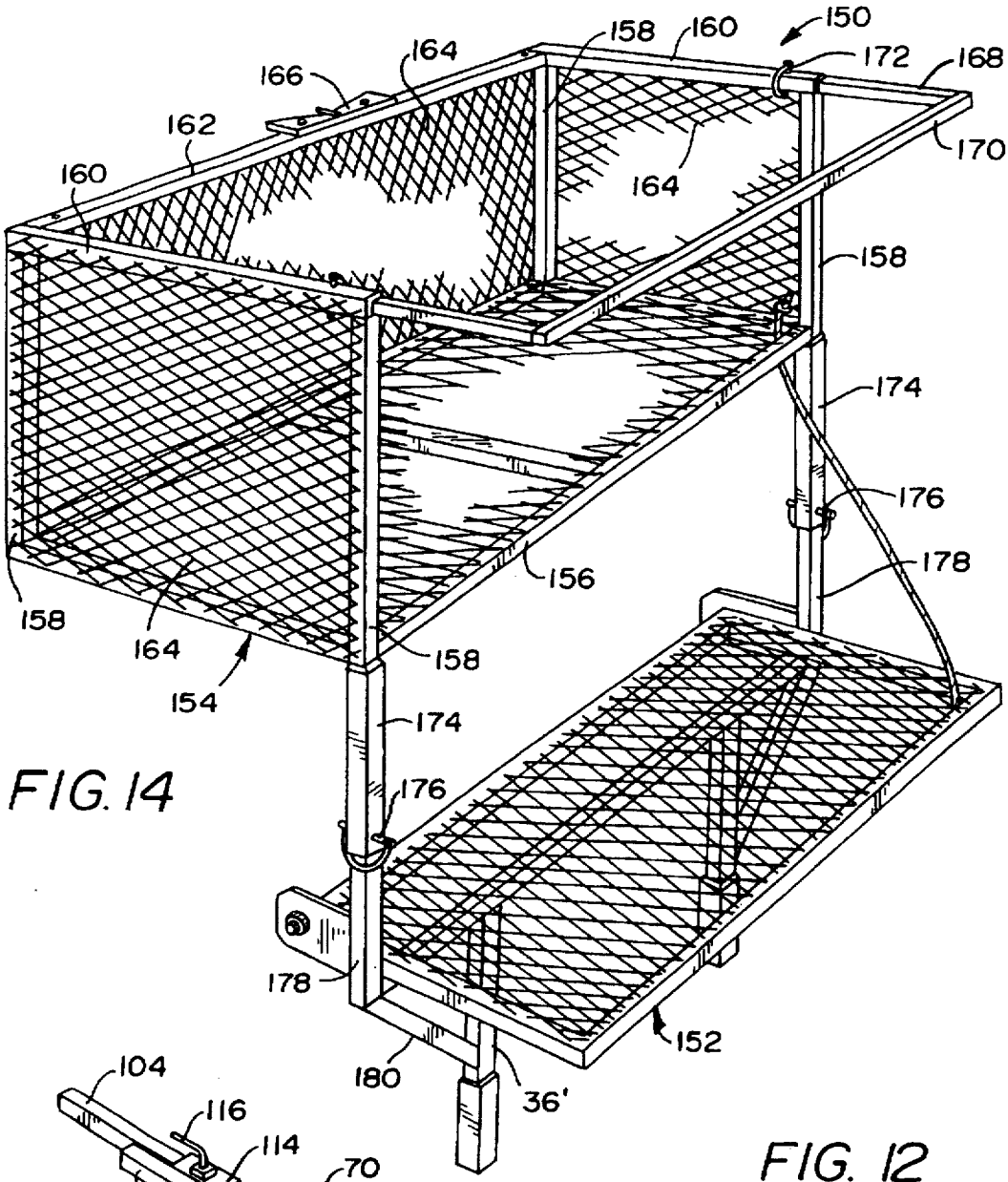
FIG. 14
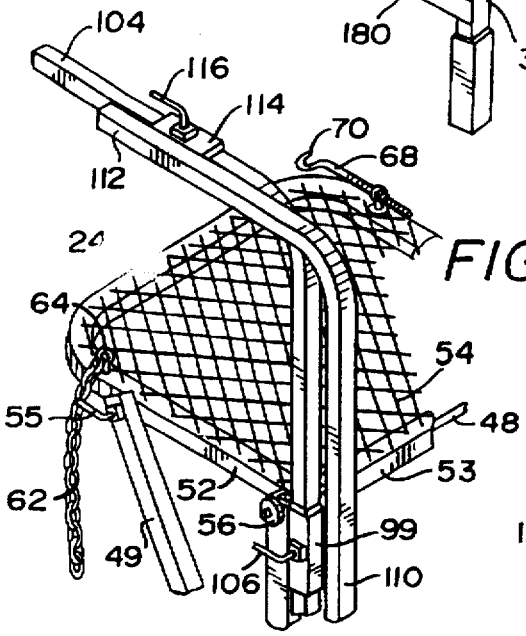
FIG. 11
FIG. 12
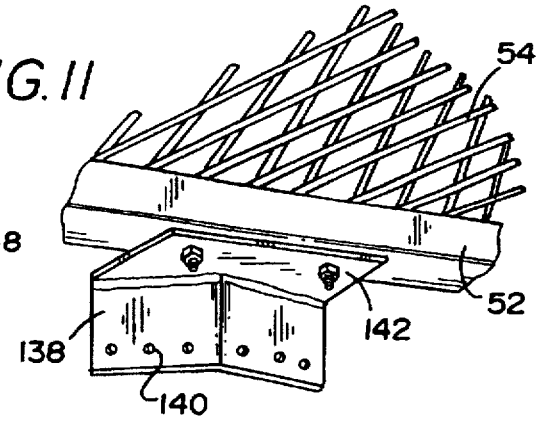

TREE STAND

BACKGROUND OF THE INVENTION

1. Field of the Invention

The present invention generally relates to tree stands to provide an elevated support for a hunter or hunters against a tree trunk. More specifically, the present invention is directed to tree stands having an elongated sectional ladder, a platform seat and footrest at its upper end, and safety front and side rails associated with the seat. Anchoring structure is provided for securing the tree stand to the tree trunk.

2. Description of the the Prior Art

Various prior patents exist which disclose tree stands having a seat structure positioned in vertically elevated position against a tree. These prior patents also disclose various structures for securing the tree stand in position against the tree and ladder type structures to enable the hunter to climb and gain access to the top of the tree stand and position himself in a location for better observation of game. The following representative U.S. patents disclose developments in this field of endeavor:

| | |
|---|---|
| 4,134,474 | 4,246,981 |
| 4,552,247 | 4,579,198 |
| 4,742,888 | 4,905,792 |
| 5,105,908 | 5,241,772 |
| 5,279,390 | 5,332,063 |
| 5,368,127 | 5,371,966 |

However, the prior patents do not disclose the features unique to the tree stand embodiments of the present invention. Specifically, the prior patents do not disclose an equivalent sectional ladder, pivotal seat, pivotal footrest, front and side rails above the seat or the unique structure for anchoring the tree stand to the tree trunk and the unique telescopic brace intermediate the top and bottom of the ladder. Further, the prior patents do not disclose a tree stand which, when disassembled and collapsed, can be stored or transported in a simple and compact arrangement of the component parts and which can be set up and secured to a tree trunk in a short period of time by one person.

SUMMARY OF THE INVENTION

An object of the present invention is to provide a tree stand for attachment to a tree trunk which includes a sectional vertically elongated ladder having a platform seat mounted at its upper end and a structure to secure an edge of the platform seat remote from the ladder in secure anchored engagement with a tree trunk.

Another object of the present invention is to provide a tree stand which can be constructed in a single wide model for a single person or a double wide model for two people.

A further object of the present invention is to provide a tree stand in which the platform seat is provided with side rails and a front rail which function to retain an occupant in place on the seat. The front rail also provides a gun rest to maintain a gun in position for immediate use.

Still another object of the invention is to provide a tree stand in accordance with the preceding objects in which the ladder is made up of several separable segments and the seat is pivotally connected to the upper segment of the ladder and can be folded to a position generally in the same plane as the upper ladder segment to facilitate compact storage and transport of the tree stand.

A still further object of the present invention is to provide a tree stand having a pivotal footrest which can be pivoted to an out of the way position when a person is climbing the ladder to enable a person to gain access to the seat without interference from the footrest. The footrest can then be pivoted to a horizontal operative position for use as a footrest by a seat occupant. When descending from the seat, the footrest can again be pivoted to the out of the way position. This enables a person to more easily climb onto the seat and climb off of the seat by pivoting the footrest between its operative and its out of the way positions.

Yet another important object of the present invention is to provide a tree stand in accordance with the preceding objects in which the structure for anchoring the seat to the tree trunk includes a single spike oriented at the apex of a V-shaped member which engages the tree trunk and combines with a chain, eye bolt and hook bolt arrangement connected with the seat to enable the chain to be tightened around the tree trunk in a manner to assure that the spike on the seat will penetrate into the tree trunk.

Another important and significant object of this invention is to provide a tree stand in which a brace intermediate the ends of the ladder is of telescopic construction and combines with retaining ropes to secure the ladder in position when the tree stand is being installed so as to securely retain the tree stand in place while the occupant climbs to the seat and anchors the seat to the tree trunk.

Another important object of the present invention is to provide a tree stand in accordance with the preceding objects in which the seat and footrest are constructed of perforated metal or other rigid material and the double wide model includes perforated metal or screen material along the back and two sides of the seat section.

Still another significant feature of the present invention is to provide a tree stand in which the side rails and front rail are separable units that can be secured to the upper ladder segment when the tree stand is being installed onto the tree trunk and then secured in operative position in relation to the seat after the user of the tree stand gains access to the seat. The front rail is returned to a vertical stored position alongside the side rail when the hunter leaves the tree stand thus enabling the tree stand to be safely used.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a longitudinal, sectional view taken along section line 3—3 on FIG. 1 illustrating the structure of the telescopic ladder brace in accordance with the present invention.

FIG. 4 is an enlarged perspective view of the upper end portion of the tree stand in accordance with the present invention, illustrating the structure of the pivotal seat, the pivotal footrest, the side and front rails and the chain and hook bolt structure for anchoring the seat to the tree trunk.

FIG. 5 is a fragmental perspective view of the structure on the seat which engages the tree trunk in accordance with the present invention, including the single spike located at the apex of a V-shaped plate member.

FIG. 6 is a fragmental perspective view of the eye bolt and hook bolt connected thereto and mounted on the seat to secure the chain in tight encircling engagement with the tree trunk.

FIG. 7 is a detailed sectional view taken along section line 7—7 on FIG. 4 illustrating the pivot structure for the seat.

FIG. 8 is a detailed sectional view taken along section line 8—8 on FIG. 4 illustrating the manner in which each side of the front rail is secured to the rearwardly extending portion of a side rail.

FIG. 9 is a perspective view illustrating the seat and footrest in a collapsed folded position in relation to the upper ladder segment.

FIG. 10 is a perspective view illustrating the side rails and front rail in a disassembled and collapsed condition for compact storage and transport.

FIG. 11 is a fragmental perspective view illustrating the manner in which the front rail can be removed and stored vertically alongside the upper ladder segment.

FIG. 12 is a fragmental perspective view of an alternate embodiment of the V-shaped plate member on the seat that can be nailed to the tree trunk.

FIG. 14 is a perspective view of a double wide model of the tree stand in accordance with the present invention.

DESCRIPTION OF THE PREFERRED EMBODIMENTS

Figure 1:
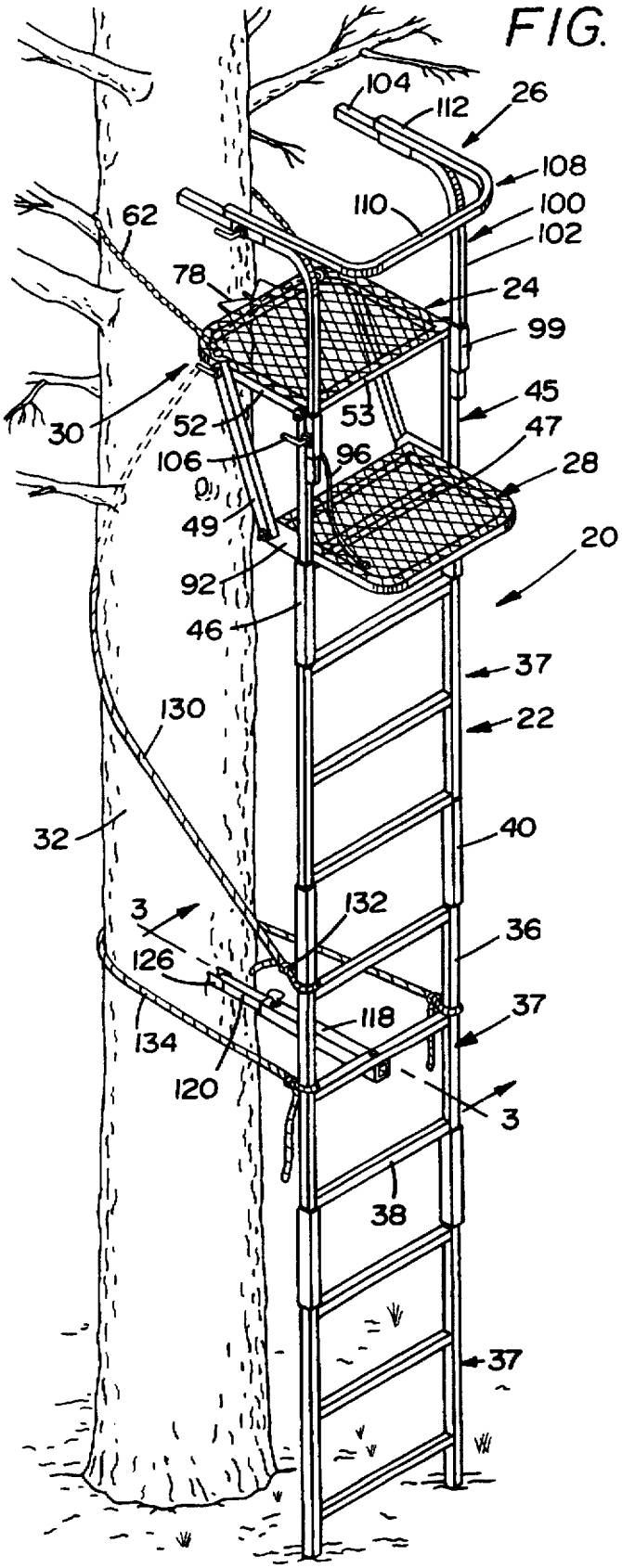
FIG. 1 is a perspective view of the single wide form of a preferred embodiment of the tree stand of the present invention illustrating its association with a tree when fully installed.

In describing the preferred embodiment of the present invention as illustrated in the drawings, specific terminology will be resorted to for the sake of clarity. However, the invention is not intended to be limited to the specific embodiment illustrated and terms so selected; it being understood that each specific term includes all technical equivalents which operate in a similar manner to accomplish a similar purpose.

The tree stand of the present invention is generally designated by reference numeral 20 and includes a ladder 22 having a platform seat 24 at the upper end thereof together with a guard rail assembly 26, a footrest 28 and a structure 30 for anchoring the seat 24 to a tree trunk 32. The ladder 22 includes a brace 34 intermediate its ends to also brace the ladder against the tree trunk 32.

Figure 2:
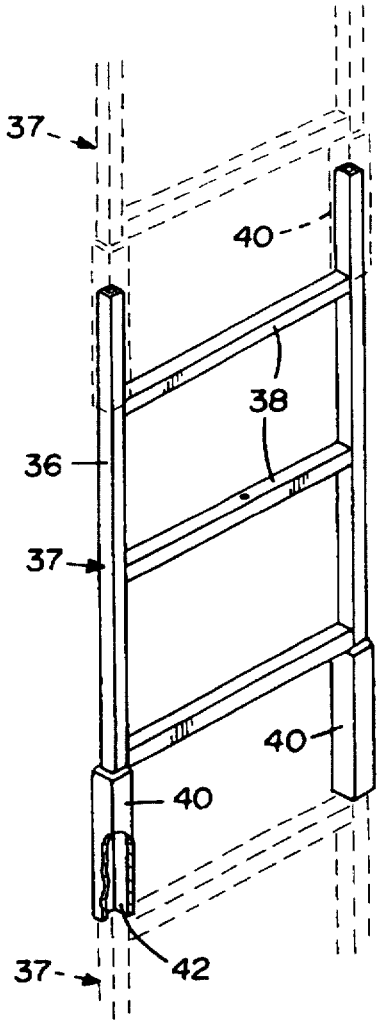
FIG. 2 is a fragmental perspective view with portions broken away illustrating the structure of one of the ladder segments in accordance with the present invention.

The ladder 22 is preferably constructed of multiple segments 37 each of which includes side rails or stiles 36 and cross members or rungs 38 perpendicular thereto and rigid therewith. Each ladder segment 37 may conveniently be approximately 4 feet in overall length. The side rails 36 as well as the rungs 38 of each ladder segment 37 are preferably formed from tubular members, more preferably square tubular members. The lower end of each side rail 36 of each ladder segment 37 is provided with a tubular sleeve 40 having its upper end rigidly fixed to the side rail 36 and having its open bottom end 42 extending below the lower end of the side rails 36 so that the sleeve 40 will form a telescopic connection with the next lower ladder segment 37. This structure is best illustrated in FIG. 2 and enables the ladder 22 to be disassembled and collapsed by separating the ladder segments 37 from each other to enable them to be stacked alongside of each other. This structure also provides a stable connection between the ladder segments. As illustrated, the sleeves 40 preferably have a length that is approximately equal to the distance between the ladder rungs 38 so that the sleeves provide an overlapping connection between the ladder segments, limit the penetration of the side rails of the lower segment into the sleeve 40, and rest on the top cross member or rung 38 of the lower segment, all to provide a rigid interconnection between segments 37 for assembling the vertically disposed ladder 22.

Turning now to FIG. 4, the platform seat 24 includes a pair of vertical side rails 44 which make up the uppermost ladder segment 45. Rails 44 are provided with a rung 47 and sleeves 46 at the lower ends thereof. The rung 47 and sleeves 46 are the same as the rungs 38 and sleeves 40 in the lower ladder segments. The sleeves 46 engage the uppermost end of the next lower ladder segment 37. The seat 24 includes a seat member 50 preferably formed by a peripheral U-shaped frame 52 and a support bar 53 interconnecting the legs of frame 52. The frame and support bar are preferably made of square tubing and a perforated metal or heavy screen panel 54 is rigidly affixed along their upper surface to form the seat. The seat 24 is pivoted between the upper ends of the side rails 44 by an elongated pivot rod 48 which extends through the support bar 53 and the upper ends of the side rails 44. A washer 56 is welded to each outer end of rod 48, as shown in FIG. 7, so that the seat 24 can pivot to a collapsed position between the side rails 44, as illustrated in FIG. 9, by pivoting upwardly, forwardly and downwardly to a vertical position about pivot rod 48.

The seat 24 is supported in horizontal operative position by a pair of supporting braces 49 which have their upper ends detachably connected to the legs of the U-shaped frame 52 at a point remote from pivot rod 48. An L-shaped retaining screw 55 has an inner threaded end portion 59 which extends through the brace and is threadedly engaged with an aperture in the frame 52 which may be reinforced by a nut welded thereto. The lower end of each brace 49 is pivotally connected to a pivot rod 94 which pivotally supports the footrest from brackets 92. The lower end of the braces 49 are retained in place on the pivot rod 94 by washers 95 welded to the outer ends of rod 94 to enable the braces to pivot to a vertical stored position, as shown in FIG. 9, and to rigidly support seat 24 in a horizontal position, as illustrated in FIG. 4.

The structure 30 for anchoring the seat 24 to the tree trunk 32 includes an elongated flexible element 62 preferably in the form of a chain, strap or the like, having one end anchored to an eye bolt 64 which extends vertically above and is rigidly attached to one side of the frame 52 in remote relation to the pivot rod 48. The chain 62 extends around the tree trunk and is connected at its other end to a vertical eye bolt 66 which extends through the frame 52 at a corner of the frame 52 opposite from bolt 64 and at the opposite side of the tree trunk 32. The eye bolt 66 receives a threaded hook bolt 68 through its eye. The bolt 68 has a hook 70 on one end engaged with the chain 62 as illustrated in FIG. 6. The threaded portion 69 of the hook bolt 68 is provided with a nut and washer 72 thereon which cooperates with the eye bolt 66 to move the hook bolt 68 in a direction to tighten the chain 62 around the tree trunk 32 or to move the hook bolt 68 to enable the chain 62 to be connected to or disconnected from the hook 70. The eye bolt 66 includes a shank which extends through the frame 52 and is anchored in place by a nut.

FIG. 5 illustrates the structure for anchoring the inner edge of the seat 24 to the tree trunk 32. This structure includes a plate member 78 secured centrally to the underside of the frame 52 by bolts 80. The plate member 78 is of shallow V-shaped configuration and includes inclined edges 82 defining a shallow V-shaped recess designed to engage the tree trunk 32 and center the seat 24 in relation to the tree trunk 32. The plate member 78 is provided with a single pointed spike 84 centrally thereof which is rigidly secured as by welding 86 to the center of V-shaped plate member 78 and extends outwardly beyond the V-shaped plate member 78 and frame 52 as illustrated in FIG. 4. The spike 84 engages and penetrates into the tree trunk 32 when the hook bolt 68 engages the chain 62 and pulls it tight as the nut 72 is tightened, thereby securely anchoring the V-shaped plate member 78, frame 52 and the inner edge of the seat 24 to the tree trunk. While a single spike 84 is preferred, it may be desirable in some instances to use more than one spike to penetrate the tree trunk.

The footrest 28 which is the same width, and preferably the same size and construction, as seat 24 is supported pivotally between the side rails 44, as illustrated in FIG. 4. The footrest 28 preferably includes a generally U-shaped frame 88 having an inner support bar 89 connecting the legs of frame 88. The frame 88 and support bar 89 are also preferably made of square tubing, and have a wire mesh or perforated metal member 90 attached to their upper surface. The lower end of each side rail 44 includes an inwardly extending bracket 92 in the form of a vertical plate. The frame 88 extends inwardly between the side rails 44 and brackets 92 and is pivotally connected to the brackets by a pivot rod 94 which extends through brackets 92 and the support bar 89. Each end of the pivot bar 94 includes a retaining washer 95 welded thereto just outwardly of brackets 92 to enable the footrest 28 to be pivoted from a generally horizontal position to a vertical position which is out of the way when climbing up or down ladder 22. When pivoted past the vertical position, the outer edge of the footrest 28 can engage with the tree trunk so that the person gaining access to or leaving the seat 24 will not come into contact with footrest 28. The rung 47 on the uppermost ladder section 45 supports the footrest 28 in its horizontal operational position when it extends outwardly beyond the outer surface of the ladder 22, as illustrated in FIGS. 1 and 4.

A flexible rope or cable 96 is attached to a forward or outer end portion of the footrest 28 as at 93 and extends upwardly and through the mesh 54 of the seat 24 and washer 97 oriented above and welded or otherwise engaged with the upper surface of mesh 54. The rope or cable terminates in a knot 98 to prevent the end from slipping away from seat member 50. This rope or cable 96 enables an operator sitting in seat 24 to pull the footrest 28 so that it pivots upwardly and inwardly beyond the vertical side rails to an inclined position out of the way of the rung 47 at the lower end of the uppermost ladder section 45, or outwardly to the horizontal operative position. Thus, after the person using the tree stand has gained access to the seat, the cable may be grasped and pulled in a manner to pivot the footrest from an inwardly inclined position past the vertical position down to the horizontal operative position, as illustrated in FIGS. 1 and 4. Similarly, a person when leaving the seat 24 can pull the rope or cable to pivot the footrest upwardly and inwardly past the vertical position thereby providing unobstructed access to the ladder rung 47 without interference from the footrest 28.

Each of the side rails 44 includes a short tubular sleeve 99, preferably of a square configuration, that is rigidly affixed to the side rails and terminates below the seat 24. A pair of L-shaped side rails 100, also preferably made of square tubing, are provided to extend above the seat 24. The side rails 100 have a vertical component 102 telescoped into the sleeves 99 and a horizontal component 104 extending toward the tree trunk 32 in generally parallel relation to the seat 24 and spaced vertically above the side edges of the seat 24, as illustrated in FIGS. 1 and 4. Each of the sleeves 99 includes an anchoring screw 106, preferably L-shaped, which extends into engagement with the vertical segment 102 of the side rail 100. This assembly secures the side rails 100 in place while at the same time enabling the side rails to be vertically adjusted and removed by a person sitting in or having access to the seat 24. The side rails 100 can be assembled with the sleeves 99 prior to the tree stand being positioned against a tree trunk or they can be assembled after the tree stand has been positioned in secure engagement with the tree trunk.

Attached to the horizontal segment 104 of each of the side rails 100 is a U-shaped front rail, also preferably of square tubing, generally designed by numeral 108, which includes a front component 110. Front component 110 extends transversely between the side rails 100 generally slightly above the horizontal segments 104, generally forwardly of the side rails 44 and generally forwardly of the support bar 53 of the seat 24. The rail 108 also includes horizontal side rails 112 each of which includes a sleeve 114 mounted on the underside thereof as by welding or the like. The sleeves 114 slidably and adjustably receive therein the horizontal segments 104 of the side rail 100. Preferably, L-shaped clamp screws 116 are provided in the side wall of sleeves 114 to secure the sleeves 114 in adjusted position to position the front component 110 in adjusted relation to the seat 24. This structure enables the sleeves 114 to be engaged with the side rails 100 in a manner which allows forward and rearward adjustment of the front rail 108. This structure also enables the front rail 108 to be completely removed from the two segments 104. In addition, this structure enables the front rail 108 to be attached vertically to one of the segments 104 so as to be secured in a position alongside side rail 100 and outwardly of seat 24 during assembly of the tree stand with the tree, as shown in FIG. 11. Thus, when a person gains access to the seat, the stored rail 108 can be removed and both of the sleeves 114 positioned on the horizontal segments 104. The user of the tree stand is thereby retained by the tree stand on both sides and the front and by the tree trunk in the back. The forward rail 110 also provides a convenient gun rest to enable a hunter to maintain the gun at a ready position. The gun rest formed by the front rail can optionally be covered with a cushioning material. Also, the rail 108 when mounted on rails 100 can be lowered to a position adjacent the knees of an occupant by operation of anchoring screws 106, to facilitate use of a bow and arrow when bow hunting, for example.

FIG. 9 illustrates the seat 24 and footrest 28 in folded and nested position with uppermost ladder section 45. When stored, the seat 24 is pivoted about rod 48 in an upwardly direction, past the vertical and then downwardly to a position between side rails 44 with plate member 78 engaging rung 47. The footrest 28 pivots about pivot rod 94 to a vertical position between brackets 92 and the support braces 49 which has its upper end disconnected from seat 24. A resilient bungee cord 113 with hook ends may be placed in encircling relation to the folded and collapsed components as shown in FIG. 9 to retain these components in compact condition when storing or transporting the tree stand. The side rails 100 and front rail 108 can be assembled in a stored position, as illustrated in FIG. 10, and be stored and retained alongside the components in FIG. 9 by the same bungee cord if desired.

FIG. 3 illustrates the structure of the ladder brace 34 which includes an outer tubular member 118 telescopically receiving a smaller inner tubular member 120. Preferably, members 118 and 120 are also made from square tubing. The tubular member 118 is secured by a bolt 121 or the like to the bottom of the center of the intermediate rung 38 on an intermediate ladder segment 37. The bolt 121 is received in hole 122, as illustrated in FIG. 2. A lock screw 124 is provided in the tubular member 118 for securing the member 120 in longitudinally adjusted relationship in tubular member 118. The outer end of the member 120 is preferably provided with a pair of spaced V-shaped plates 126 which engage the tree trunk 32, as illustrated in FIG. 3.

When installing the tree stand, it is assembled alongside a tree and is elevated to a vertical position so that the plate 78 on inner end of the seat 24 is engaged with the tree trunk by engaging the spike 84 and V-shaped plate member 78 with the tree trunk 32. A rope 130 or the like connected to a corner of the seat 24 is wrapped around the tree trunk 32 in a spiral manner with the rope 130 being anchored to the ladder 22 on the opposite side of the seat and tree trunk at an accessible elevation, such as at 132. This stabilizes the tree stand during assembly with the tree trunk 32. The tree stand is further stabilized by using a rope 134 tied from the ladder 22, at one side, around the tree trunk 32 generally in the vicinity of the brace 34 with the other end of the rope being anchored to the ladder at the other side of the tree trunk. The lower portion of the ladder 22 is then forced outwardly in relation to the tree trunk against the ropes while the brace 34 is elongated and locked in adjusted position to positively and securely engage the tree stand with the tree trunk. This will stabilize the tree stand and serve as a safety measure while the person using the tree stand ascends the ladder and anchors the seat section to the tree trunk. The seat section is anchored by placing the chain 62 around the tree trunk and engaging it with the hook bolt 68 and tightening the hook bolt. This method of installation provides a secure and safe engagement of the tree stand with the tree trunk and eliminates possible injury due to the tree stand accidentally falling laterally away from the tree trunk, which might occur if the stand is merely leaned against the tree trunk before the seat section is anchored to the tree trunk.

Figure 13:
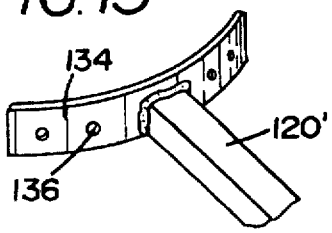
FIG. 13 is a fragmental perspective view of an alternate embodiment for an inner end of the ladder brace that can be nailed to the tree trunk in accordance with the present invention.

When installing the tree stand where the use of nails is permitted, the inner brace member 120' illustrated in FIG. 13 is used in lieu of member 120 in FIG. 3. As illustrated, an arcuate plate 134 is rigidly affixed to the end of brace member 120', as by welding or the like, and engages the peripheral surface of the tree trunk 32. The plate 134 includes a plurality of apertures 136 spaced along the length thereof for receiving nails which are driven into the tree trunk to securely retain the lower portion of the ladder in place. Preferably, double headed forming nails are used to facilitate removal in the event the tree stand is to be relocated. In this mode of installation, the V-shaped plate 138, as illustrated in FIG. 12, is substituted for the V-shaped plate 78 in FIG. 5. The plate 138 has apertures 140 for receiving double headed nails and a mounting flange 142 to secure the plate 138 to the seat 50. The plate 138 can be welded to the frame 52 or bolted as shown. By nailing the plate 138 to the tree trunk 32, the seat and upper end of the ladder are securely anchored to the tree trunk.

FIG. 14 illustrates a double wide form of the tree stand in accordance with the present invention, generally designated by the numeral 150, which is wide enough to support two hunters. In this construction, the footrest 152 and seat 154 are wide enough to support two adult individuals so that either or both may use a gun. The seat 154 includes a seat frame 156, upstanding corner frame members 158 and top side rails 160 and a rear top rail 162, are preferably made of square tubing. The seat frame, sides and rear of the seat are closed by a heavy screen or expanded metal 164. The center of the top rear rail includes a V-shaped plate 166 which is the same as plate 78 in FIG. 5.

The top side rails 160 telescopically receive the legs 168 of a U-shaped front rail 170. A lock pin 172 is provided to enable the front rail 170 to be adjusted toward and away from the hunters occupying the seat. The seat 154 is secured to the tree trunk in the same manner as the single wide form of the tree stand is secured and the footrest functions in the same manner. The front corner members 158 include a sleeve 174 and lock pin 176 which connects square tubular extensions 178 to the corner members 158. The extensions extend below the footrest 152 and extend inwardly at 180 to connect with upper ends of ladder side rails 36'. The installation and use of the double wide form of tree stand is the same as the single wide tree stand 20.

The foregoing is considered as illustrative only of the principles of the invention. Further, since numerous modifications and changes will readily occur to those skilled in the art, it is not desired to limit the invention to the exact construction and operation shown and described. For example, square aluminum tubing is preferred for the structural members, such as the ladder side rails 36 and 44 and rungs 38, seat frame 52, footrest frame 88, seat side rails 100, and seat front rail 108, to provide strength and rigidity as well as light weight. Such components could be solid, made of any sufficiently strong material including metals and plastics, and other tubular configurations such as round. In addition, it is preferred that all of the L-shaped retaining screws, such as screws 58, 106 and 116, be of the same size and construction for ease and simplicity of manufacture and assembly, and threaded nuts may be welded to the tubing to provide greater thread area for the screws, as illustrated in the drawings. Further, other conventional screwing and bolting mechanisms can be readily substituted. Accordingly, all suitable modifications and equivalents may be resorted to, falling within the scope of the invention.

What is claimed as new is as follows:

1. A stand supported against an upwardly extending support member in elevated relation to a supporting surface, said stand comprising a generally horizontally disposed seat platform, a ladder connected to an edge portion of the seat platform and extending downwardly from said edge portion to a supporting surface to provide access to said seat platform, anchoring structure associated with a portion of said seat platform opposite to said ladder to anchor said seat platform to an upwardly extending support member, said seat platform including side rails supported above the seat platform and a front rail extending between outer ends of said side rails above the edge portion of the seat platform having the ladder connected thereto, said front rail providing a gun support rail and being detachably connected to the side rails to enable access to the seat platform from the ladder when the front rail is separated from the side rails and retaining an occupant on the seat platform when the front rail is connected to and extending between the side rails, said ladder including an extendable and retractable footrest platform mounted thereon below the seat platform a distance to support the feet of an occupant seated on the seat platform, said ladder and footrest platform being freely pivotally interconnected to enable the footrest platform to be pivoted between a horizontal position resting on a ladder rung and projecting from the ladder away from the support member for engagement by the feet of a seat platform occupant and a position inwardly of the ladder enabling unimpeded access to ladder rungs when an occupant is climbing or descending the ladder.

2. The stand as defined in claim 1 wherein said ladder includes an anchoring structure spaced below the platform to anchor the ladder to the supporting member.

3. The stand as defined in claim 2 wherein the anchoring structure below the platform includes a telescopic brace secured to a ladder rung and extending into engagement with the support member.

4. The stand as defined in claim 3 together with a flexible member attached to a side of said ladder and extending around the support member and adjustably connected to an opposite side of the ladder to retain the brace in engagement with the support member.

5. The stand as defined in claim 3 wherein said brace terminates in a plate having spaced holes therein receiving nails driven into the support member to retain the brace in engagement with the support member.

6. The stand as defined in claim 1 wherein said platforms are interconnected by a flexible member in spaced relation to a pivot axis of the footrest platform to enable an occupant of the seat platform to pivot the footrest platform to a desired position.

7. The stand as defined in claim 1 wherein said seat platform includes a seat member of generally rectangular configuration, said anchoring structure including a projecting member mounted on said portion of the seat member and extending toward and into engagement with the support member and a flexible member adjustably connected to the seat member and extending around the support member to retain the projecting member engaged with the support member.

8. The stand as defined in claim 7 wherein the support member is a tree trunk, said projecting member on the seat member terminating in a tree trunk engaging member generally conforming with the tree trunk configuration.

9. The stand as defined in claim 8 wherein said tree trunk engaging member is a shallow V-shaped member engaging the tree trunk and a pointed member centrally mounted on said V-shaped member and penetrating into the tree trunk.

10. The stand as defined in claim 8 wherein said tree trunk engaging member terminates in an arcuate plate conforming with a portion of a periphery of the tree trunk, said plate including a plurality of spaced holes receiving nails driven into the tree trunk to anchor the stand to the tree trunk.

11. The stand as defined in claim 1 wherein said seat platform includes a generally rigid rectangular seat member rigidly connected to said ladder, said seat platform including a generally horizontally disposed back rail above the seat member and connected to inner ends of the side rails, said seat member, back rail and front rail being generally parallel, a screen material extending between the side rails and seat member and between the back rail and seat member to close the space between the seat member and the side and back rails.

12. The stand as defined in claim 11 wherein said seat member and rails are dimensioned to enable two occupants to be seated on the seat member.

13. A stand as defined in claim 11 wherein said front rail is adjustably and detachably connected to said side rails for movement toward and away from an occupant of the seat member and to provide access to and egress from the seat member when the front rail is removed.

14. The stand as defined in claim 11 wherein said anchoring structure associated with a portion of said seat platform opposite to said ladder including a projecting member mounted on said back rail and extending toward and into engagement with the support member.

15. The stand as defined in claim 11 wherein said seat platform is detachably connected to said ladder to enable disassembly of the seat platform and ladder.

16. A stand as defined in claim 1 wherein said ladder includes a plurality of equally spaced horizontally disposed rungs, a pair of support brackets on said ladder in horizontally spaced relation, said brackets extending inwardly toward said support member, said footrest platform having an inner edge portion pivotally connected between said brackets for free pivotal movement about an axis spaced inwardly from and generally in alignment with a ladder rung, said footrest platform having an outer portion extending outwardly beyond the ladder and supported in generally horizontal position on said ladder rung aligned with the brackets for engagement by the feet of an occupant seated on said seat platform, said footrest platform being pivotal upwardly about said axis to position the footrest platform spaced inwardly of the ladder rung to enable unimpeded access to said ladder rung.

17. A stand as defined in claim 16 wherein said footrest platform includes a flexible member connected to the footrest platform in spaced relation to said axis and extending upwardly for access to an occupant of the seat platform to enable said occupant to pivot the footrest platform from a generally horizontal position to a position inwardly of the ladder.

18. A tree stand of sectional and pivotal construction to enable transport and storage in a compact condition, said tree stand comprising a generally horizontally disposed sitting platform at an elevated height when said stand is assembled, a ladder having at least three sections with quick connections thereon for assembly thereof, said uppermost ladder section pivotally connected near its upper end to a first edge portion of said sitting platform, anchoring structure associated with a second edge portion of said platform opposite to said first edge portion to anchor said platform to a tree; a generally horizontally disposed footrest platform pivotally connected to said uppermost ladder section at a normal footrest location below said sitting platform and resting on a rung of said ladder; said footrest platform pivotable from said normal footrest location past a generally vertical position underneath said first edge portion of said sitting platform away from said rung; said upper ladder section collapsible such that the ladder section, sitting platform and footrest platform are all generally parallel and side-by-side for storage.

19. A tree stand as defined in claim 18 wherein said sitting platform includes horizontal side rails and a horizontal front rail supported above said sitting platform and being detachably connected to said sitting platform for collapsible connection for storage in a compact condition.

* * * * *